United States Patent [19]

Fore

[11] Patent Number: 4,524,825

[45] Date of Patent: Jun. 25, 1985

[54] WELL PACKER

[75] Inventor: William M. Fore, Duncan, Okla.

[73] Assignee: Halliburton Company, Duncan, Okla.

[21] Appl. No.: 557,090

[22] Filed: Dec. 1, 1983

[51] Int. Cl.[3] ..... E21B 33/129

[52] U.S. Cl. ..... 166/139; 166/140; 166/217

[58] Field of Search ..... 166/134, 139, 140, 182, 166/216, 217

[56] References Cited

U.S. PATENT DOCUMENTS

| | | | |
|---|---|---|---|
| 2,389,985 | 11/1945 | Justice et al. | 166/140 X |
| 3,244,233 | 4/1966 | Villalon, Jr. . | |
| 3,279,542 | 10/1966 | Brown | 166/139 |
| 3,330,357 | 7/1967 | Elliston | 166/139 X |
| 3,507,327 | 4/1970 | Chenoweth | 166/182 X |
| 3,584,684 | 6/1971 | Anderson et al. . | |
| 3,744,563 | 7/1973 | McGill | 166/140 X |
| 3,749,166 | 7/1973 | Young . | |
| 4,078,606 | 3/1978 | Montgomery . | |
| 4,176,715 | 12/1979 | Bigelow et al. | 166/140 X |
| 4,427,063 | 1/1984 | Skinner | 166/134 |

*Primary Examiner*—Stephen J. Novosad
*Assistant Examiner*—William P. Neuder
*Attorney, Agent, or Firm*—Joseph A. Walkowski; Thomas R. Weaver

[57] ABSTRACT

The packer of the present invention includes mandrel means having first ratchet means and lug means disposed thereon, second ratchet means and drag spring means associated with tubular housing means surrounding said mandrel means, said housing means including slot means on the interior thereof, radially expandable slip means disposed about said mandrel means, a compressible packer element disposed about the lower end of said mandrel means, and packer element compression means associated with said mandrel means and said housing means.

11 Claims, 7 Drawing Figures

WELL PACKER

BACKGROUND OF THE INVENTION

It is common practice in the petroleum industry to employ so-called packing devices in the bore of an oil or gas well to isolate one or more portions of the well bore for purposes of testing, treating or producing the well. Common treating operations to enhance production from a well include, but are not limited to, acidizing and fracturing. Steam injection, water injection or injection of a gas such as carbon dioxide ($CO_2$) may also be termed as "treating" operations used to enhance the production of depleted wells or those producing heavy crude. In testing, treating and producing operations, pack-off devices, which are commonly known as "packers" or "bridge plugs," may be subjected to extremes of high temperature and pressure, in combination with corrosive fluids such as the variety of acids employed in acidizing and fracturing operations, water, steam or $CO_2$ injection fluids, and hydrogen sulfide ($H_2S$), brine and other well fluids.

These extremely hostile downhole environments must be accommodated with packers and bridge plugs designed to provide effective, leak-free seals over long periods of time, which may extend into years. In particular, when such devices are employed in producing a well, or in injecting fluids into a well on a long-term basis such as in waterflood, steam or $CO_2$ injection projects, it is expensive both in terms of rig costs and in lost production volume to have to replace them after a relatively short period of time. The problem is, of course, compounded in large fields where hundreds or even thousands of wells are being produced or fluid injected therein. Therefore, it is desirable to employ packers which are rugged, corrosion-resistant, relatively inexpensive, simple to set as well as to retrieve (when necessary), and which create a long-lasting and leakfree seal across the well bore.

Examples of a variety of retrievable prior art pack-off devices are disclosed in U.S. Pat. Nos. 3,244,233, 3,507,327, 3,584,684, 3,749,166 and 4,078,606. As may readily be seen, however, these prior art pack-off devices are relatively complex in design and construction and leave a large number of parts exposed to the hostile well environment below the device.

SUMMARY OF THE INVENTION

In contrast to the prior art, the present invention comprises a packer of rugged, corrosion-resistant design which is relatively inexpensive to produce, simple to set and to retrieve and which will effect a leak-free seal across a well bore for an extended period of time.

The packer of the present invention comprises a mandrel means having first ratchet means and lug means associated therewith, second ratchet means, slot means and drag spring means associated with a tubular housing means surrounding said mandrel means, radially expandable slip means disposed about said mandrel means, a compressible and radially expandable packer element disposed about the lower end of said mandrel means, and packer element compression means associated with said mandrel means and said housing means.

The packer of the present invention may be run into a well bore on a tubing string, set by rotation to the right and picking up the tubing string. The packer can be released and retrieved by applying right-hand rotation to the tubing string and slacking off tubing string weight.

BRIEF DESCRIPTION OF THE DRAWINGS

The packer of the present invention will be more fully understood by one of ordinary skill in the art by reviewing the following detailed description of a preferred embodiment thereof and its operation in conjunction with the accompanying drawings, wherein.

DESCRIPTION AND OPERATION OF A PREFERRED EMBODIMENT OF THE INVENTION

Figure 1A:
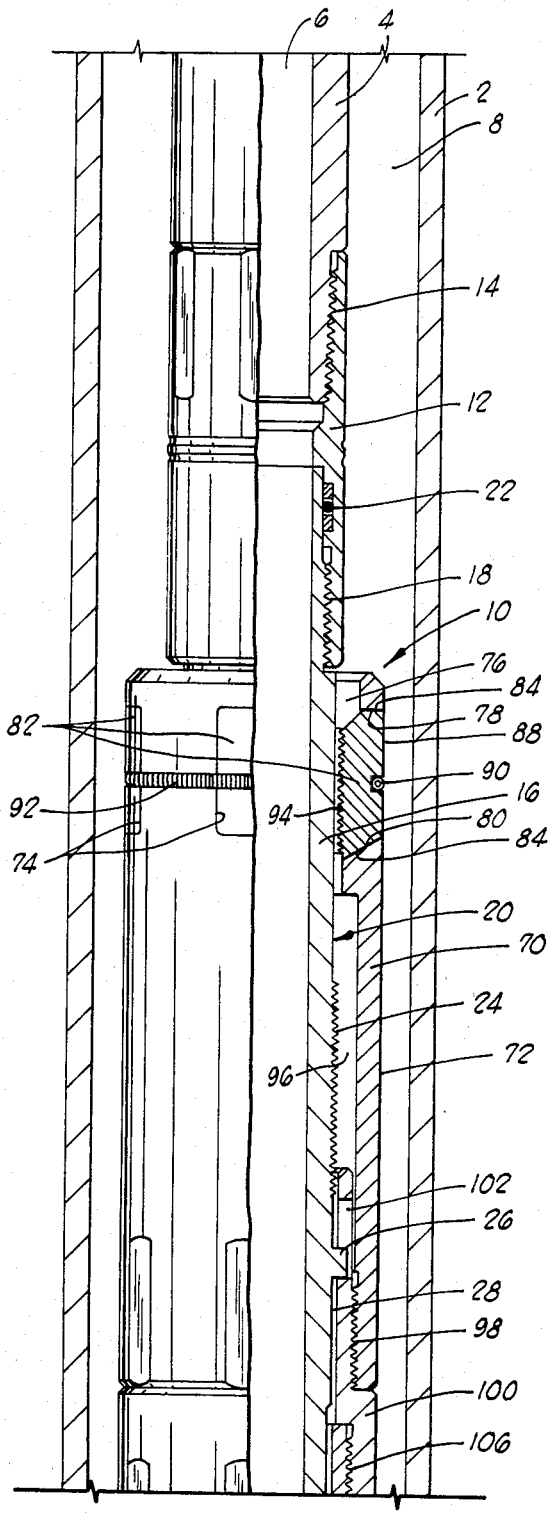
FIGS. 1A–1C show a half-section vertical elevation of the packer of the present invention disposed on a tubing string in a cased well bore.
Figure 1B:
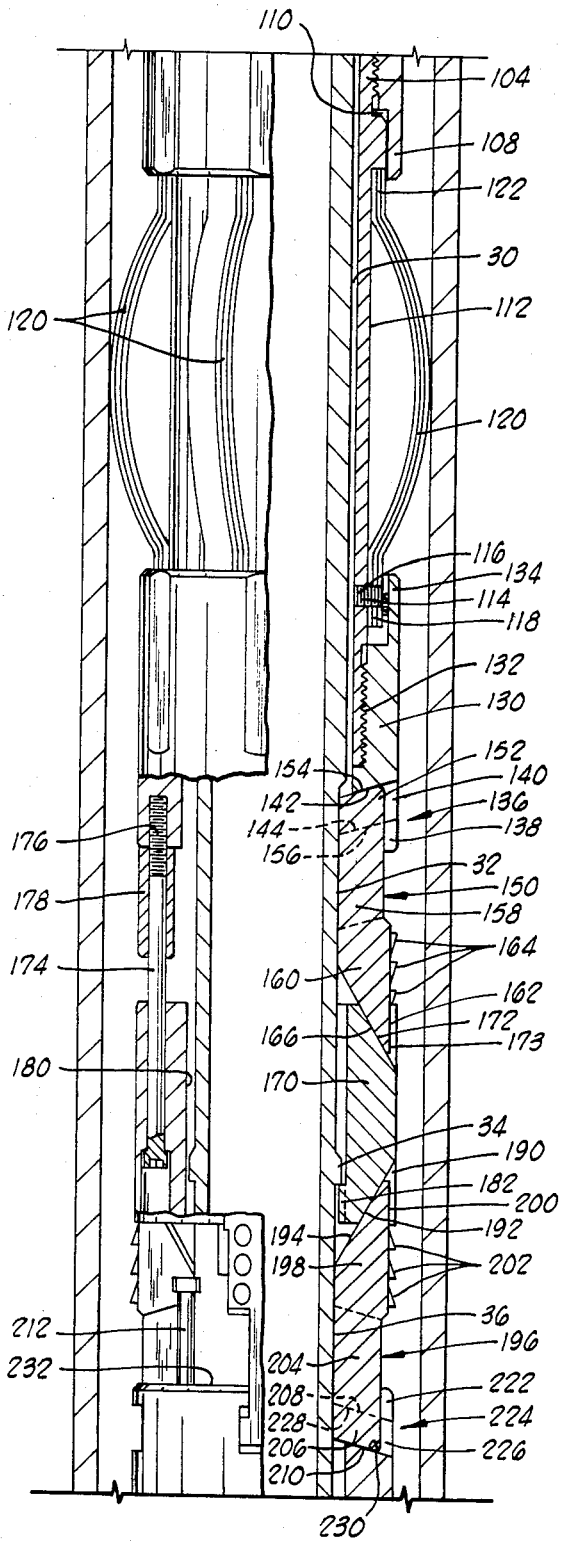
Figure 1C:
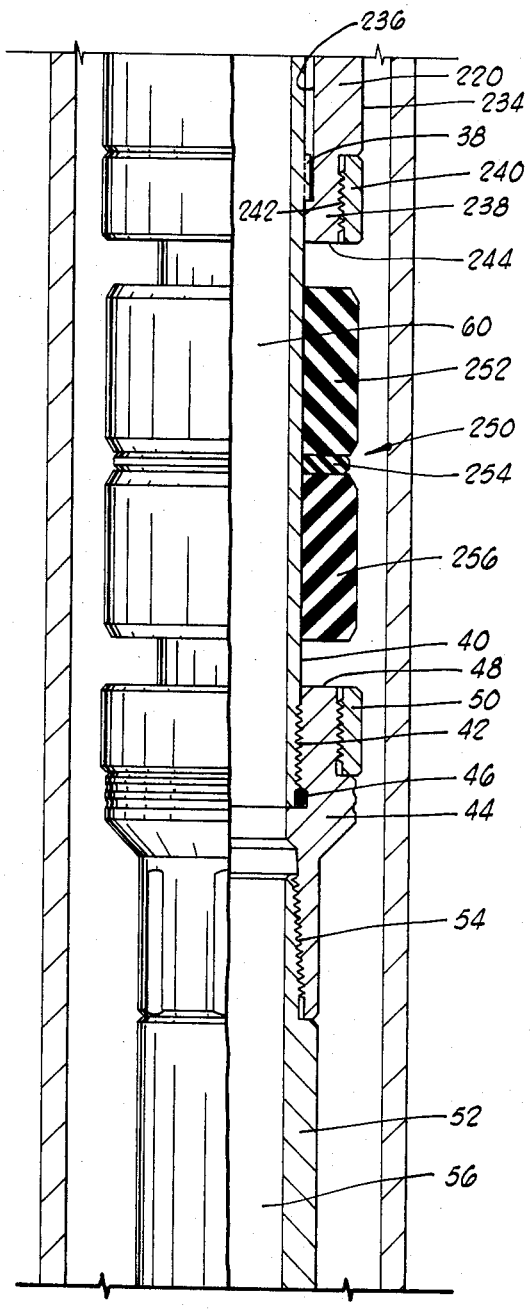

Referring to FIGS. 1A–1C of the drawings, packer 10 is shown suspended in well bore casing 2 from tubing string 4 having bore 6 therethrough. Well bore annulus 8 is defined between packer 10 and casing 2. Packer 10 is secured to tubing string 4 by upper adapter 12 at mating threads 14.

Mandrel means 20 includes upper adapter 12, which is secured to packer mandrel 16 at mating threads 18, a fluid-tight junction between upper adapter 12 and packer mandrel 16 being effected by annular seal 22. The exterior of packer mandrel 16 possesses right-hand lead threads 24 thereon, which are also referred to herein as ratchet threads. Below ratchet threads 24, at least one J-slot lug 26 protrudes radially from packer mandrel 16. Below J-slot lug 26, the outer surface 28 of packer mandrel 16 steps obliquely downward to a smaller diameter surface 30, which leads to another oblique step downward to surface 32, which ends at annular shoulder 34 having an oblique upper face and a radially flat lower face. Below annular shoulder 34, outer surface 36 of substantially the same diameter as surface 32 extends to circumferentially disposed longitudinal splines 38 having radially flat upper and lower faces. Outer surface 40 extends below shoulder 38 to the lower end of packer mandrel 16, where it is threaded at 42 to lower adapter 44, a fluid-tight seal therebetween being effected by O-ring 46. Lower adapter 44 is of substantially greater outer diameter than packer mandrel 16, and includes radially flat upper face 48, which comprises a portion of packer element compression means. Annular compression ring 50 is threaded to lower adapter 44 and extends upper face 48 to a greater radial extent.

Below lower adapter 44, a second tubing string 52 may extend downwardly from packer 10, secured thereto at threads 54. The bore 56 of second tubing string 52 communicates with bore 6 of tubing string 4 through bore 60 of mandrel means 20, which bore 20 extends through upper adapter 12, packer mandrel 16 and lower adapter 44.

Proceeding to the top of packer 10, ratchet housing 70 surrounds packer mandrel 16, housing 70 having a constant diameter outer surface 72, and a plurality of circumferentially spaced ratchet block seats 74 extending from outer surface 72 to the interior 76 of housing 70. Ratchet block seats 74 are defined by radially flat upper walls 78, oblique upwardly radially extending lower walls 80 and longitudinally extending side walls (unnumbered). A ratchet block 82 is disposed in each seat 74, ratchet blocks 82 possessing radially flat upper faces 84, oblique upwardly radially extending lower faces 86 of the same inclination as lower walls 80 and exterior surfaces 88 which in the initial position of ratchet blocks 82 are flush with outer surface 72 of housing 70. A circumferential exterior recess 90 extends through both ratchet blocks 82 and outer surface 72 of housing 70, retainer spring 92 being disposed therein about housing 70. The inner surfaces of ratchet blocks 82 comprise right-hand lead threads 94 of the same type and pitch as ratchet threads 24 on packer mandrel 16, and adapted to mate therewith.

Below ratchet block seats 74, housing 70 extends outwardly to an area 96 of increased inner diameter, the lower end of housing 70 being secured to J-slot housing 100 at threads 98.

J-slot housing 100 extends upwardly under ratchet housing 70 whereat at least one J-slot 102, into which at least one lug 26 extends, is located. Drag spring support 104 is threaded to J-slot housing 100 at 106, the lower portion of J-slot housing 100 comprising annular overshot 108 which defines annular cavity 110. The outer surface 112 of drag spring support 104 is substantially uniform, and possesses radially outwardly extending longitudinal splines 113 thereon. Drag spring support 104 is pierced by a plurality of threaded apertures 114 into which are inserted drag spring bolts 116, which secure the lower ends 118 of composite leaf drag springs 120 to drag spring support 104. The upper ends 122 of drag springs 120 are maintained in cavities 110, defined by splines 113 and by overshot 108. Splines 113 have been rotated slightly from their actual positions to show their disposition on drag spring support 104.

Upper slip guide 130 is threaded to the lower end of drag spring support 104 at 132, the upper end of upper slip guide 130 comprising annular overshot 134, which extends over the tops of drag spring bolts 116, thereby preventing them from unexpectedly backing off. Upper slip guide 130 includes radially extending slip guide channels 136 leading from lower end of slip guide 130 and defined by longitudinally extending entrance walls 138 terminating in laterally extending slip tab cavities 140. The upper and lower walls 142 and 144 of slip tab cavities 140 are upwardly radially-inclined.

Upper slips 150 are associated with slip guide channels 136, slips 150 having laterally extending slip tabs 152 having upwardly radially-inclined upper and lower faces 154 and 156 respectively, which ride in slip tab cavities 140. The intermediate portions 158 of upper slips 150 are constrained within entrance walls 138, while the lower ends 160 extend laterally beyond intermediate portions 158. Outer faces 162 of lower ends 160 carry upwardly radially-inclined teeth 164 thereon. The inner faces 166 of lower ends 160 are downwardly radially-inclined, and ride on the upper faces 172 of channels 173 of annular slip wedge body 170, which faces possess substantially the same degree of radial inclination. The inner faces 166 of lower ends 160 also possess laterally extending edges which ride within mating lateral channels (not shown) extending into the sides of channels 173 proximate upper faces 172, the resulting dovetail effect preventing upper slips 150 from falling off packer 10 while permitting longitudinal and radial movement of slips 150 as packer 10 is set.

Slip wedge body 170, as is shown in the left-hand cutaway portion of FIG. 1B, is slidably secured to upper slip guide 130 by longitudinal bolts 174, threads 176 on bolts 174 engaging mating threads tapped in upper slip guide 130. Spacer sleeves 178 are disposed between slip wedge body 170 and upper slip guide 150, the need for which will be further explained hereafter in conjunction with the operation of packer 10. The inner surface 180 of slip wedge body 170 is of greater diameter than shoulder 34 on packer mandrel 16, except at its lower end wherein longitudinal splines 182 protrude inwardly. The contact of shoulder 34 with splines 182 maintains slip wedge body 170 in a longitudinally extended position with respect to upper slip guide 130 during running of the packer 10 into the well bore.

Channels 190 of slip wedge body 170 possess lower radially inclined faces 192 which are contacted by the upper inner faces 194 of lower slips 196. Channels 190, like channels 173, possess lateral channels therein adjacent faces 192 which receive laterally extending edges of faces 194 of lower slips 196, thereby slidably constraining slips 196. Lower slips 196, like upper slips 150, possess laterally extending ends 198 proximate slip wedge body 170, which ends have outer surfaces 200 carrying teeth 202 which, however, are downwardly radially-inclined. Intermediate portions 204 of lower slips 196 are constrained within entrance walls 222 of slip guide channels 224 of lower slip guide 220, slip guide channels 224 terminating in laterally extending slip tab cavities 226. The upper 228 and lower 230 walls of slip tab cavities 226 are downwardly radially-inclined, the upper 208 and lower 210 faces of laterally extending lower slip tabs 206 having a like inclination. Stop bolts 212 are threaded into the upper face 232 of lower slip guide 220. The outer surface 234 of lower slip guide 220 is substantially round, the inner surface 236 of lower slip guide 220 being of greater diameter than that of splines 38 on packer mandrel 16, except for inward-extending annular step 238 at its lower end. The lower end of the exterior of lower slip guide 220 is stepped inwardly, annular compression ring 240 being threaded thereto at 242, and along with the lower end of lower slip guide 220, defining radially flat face 244.

Disposed about packer mandrel 16 between lower slip guide 220 and lower adapter 44 is packer element 250, including annular segments 252, 254 and 256. While packer element 250 is shown to be of elastomeric construction, it is not to be taken as so limited and may comprise any suitable material or combination of materials, metallic and nonmetallic, including but not limited to wire mesh, asbestos, plastic, fabric, etc.

Referring now to FIGS. 1A–1C, 2A–2C and FIG. 3, the operation of the preferred embodiment 10 of the packer of the present invention will be described hereafter. Packer 10 is run into the well bore casing 2 in the unset, or extended mode, with upper and lower slips 150 and 196 in their radially innermost positions. Drag springs 120 center packer 10 inside casing 2, and, when packer 10 is at the level in the well bore where it is to be set, provides an initial longitudinal resistance against which mandrel means 20 can be pulled. Packer element 250 is in an uncompressed state, disposed about packer mandrel 16.

Figure 2A:
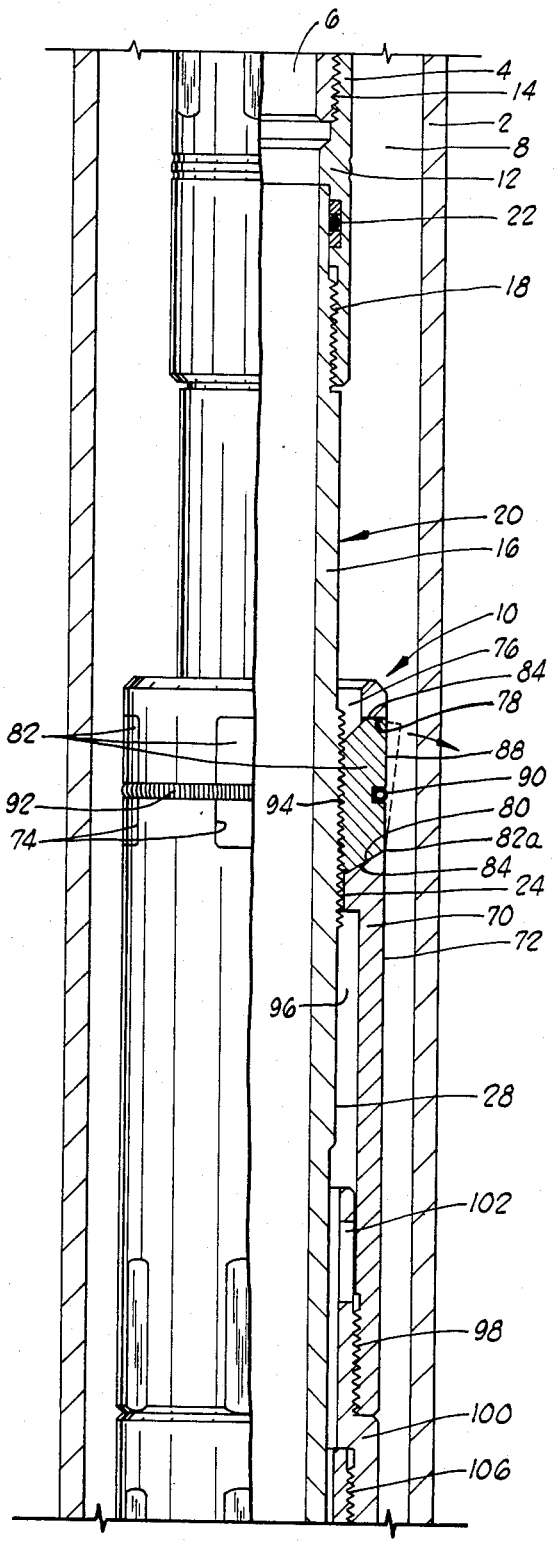
FIGS. 2A–2C show the packer of FIGS. 1A–1C set in the well bore.
Figure 2B:
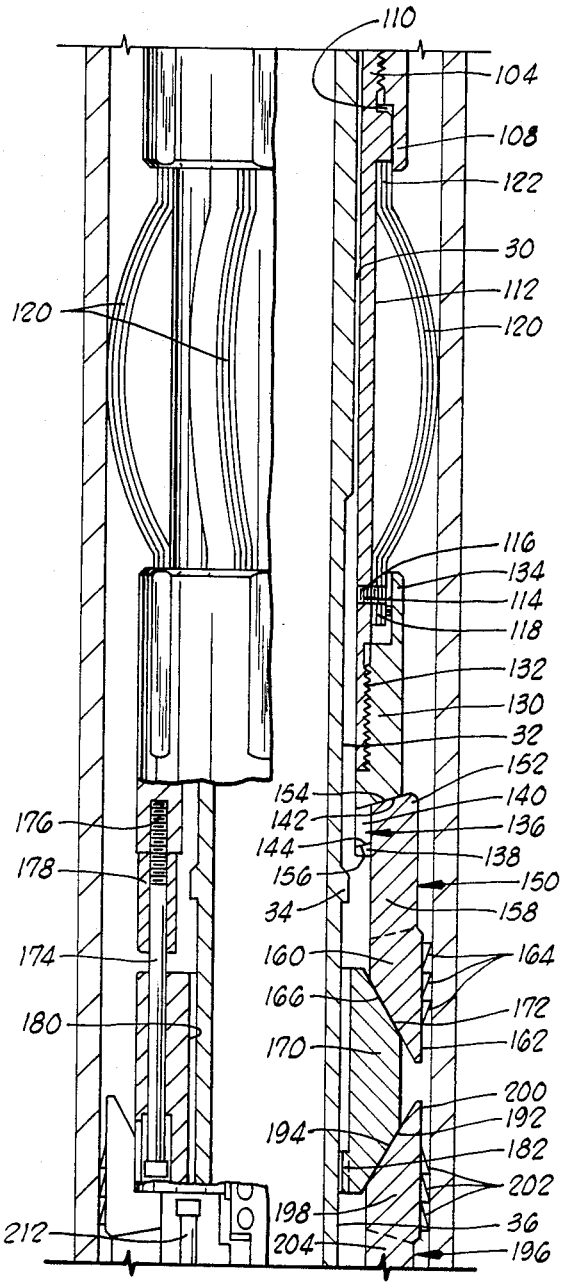
Figure 2C:
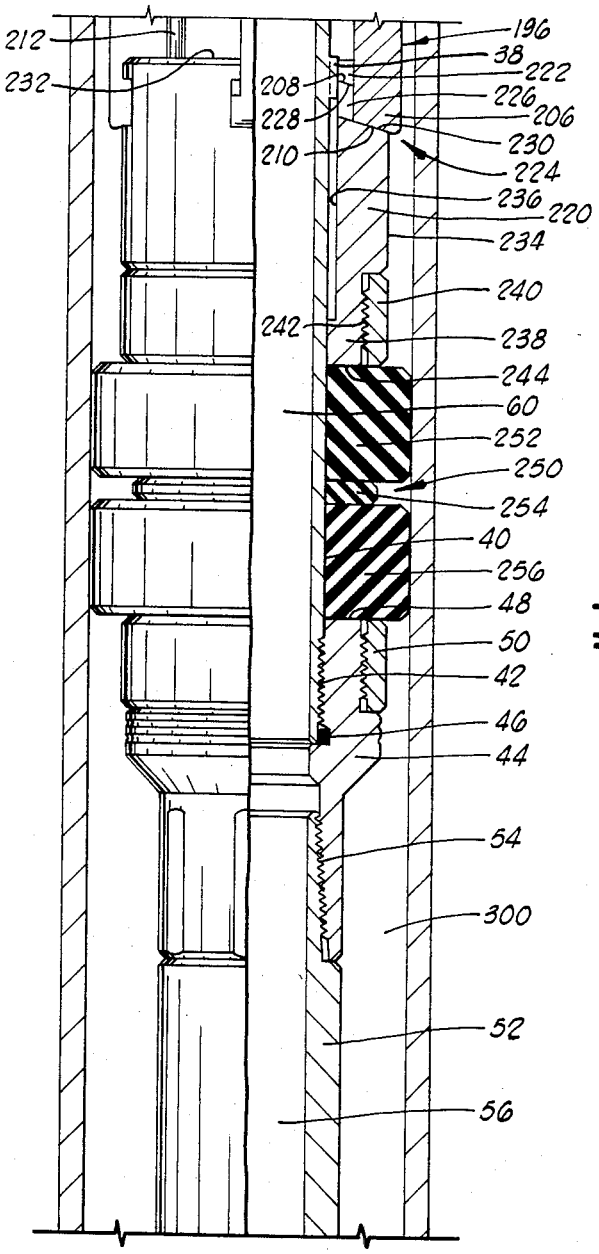
Figure 3:
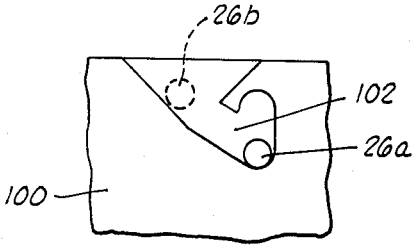
FIG. 3 is a development of the J-slot employed in the packer of the present invention.

When packer 10 is to be set, tubing string 4 is rotated to the right, which moves lug 26 (see FIG. 3) from position **26*a* to a position 26*b*, unlocking mandrel means 20 from J-slot housing 100, after which tubing string 4 is picked up to the desired amount of setting load, which may be for example and not by way of limitation, 20,000 pounds. During rotation of the mandrel means 20, lug 26 is rotated toward the reader, out of sight, as is shown in FIG. 2A. Picking up tubing string 4 picks up mandrel means 20, drag springs 120 maintaining ratchet block housing 70, J-slot housing 100, drag spring support 112 and upper slip guide 130 stationary in casing 2**.

The upward movement of mandrel means 20 forces lower adapter 44 against packer element 250, which then slides upwardly to contact lower slip guide 234. The upward movement of mandrel means 20 moves splines 38 and shoulders 34 on packer mandrel 16 upwardly, so that slip wedges 170 and lower slip guide 234 are freed to also move upwardly. Therefore, the continued upward movement of mandrel means 20 results in lower slip guide 234 moving upward, pushing lower slips 196 against slip wedge body 170, which in turn act upon upper slips 150, faces 172 on slip wedge body 170 forcing upper slips 150 outwardly, guided by the interaction of tabs 152 in tab cavities 140 in upper slip guide 130. Teeth 164 engage casing 2, and bite into it, providing a greater anchoring force than the initial resistance to upward movement provided by drag springs 120. The upward movement of slip wedge body 170 is limited by the contact of upper slip guide 130, spacer sleeve 178 and slip wedge body 170.

As mandrel means 20 continues to move upward, and upper slips 150 are fully radially extended against casing 2 by the cooperation of slip wedge body 170 with slips 150, lower slips 196 are then forced outward by lower faces 192 on slip wedge body 170, guided by the interaction of tabs 206 with tab cavities 226 in lower slip guide 220.

When lower slips 196 are fully extended outwardly against casing 2, teeth 202 bite into the casing at an angle such as to hinder any downward movement of packer 10. Upward movement of lower slip guide 220 is limited by the contact of stop bolts 212 with the faces of slip wedge body 170. Since no further slip movement or movement of packer 10 can take place, continued upward mandrel means movement compresses packer element 250 between lower slip guide 220 carrying ring 240, and lower adapter 44 carrying ring 50, which compression radially expands packer element 250 into sealing engagement with packer mandrel 16 and casing 2.

When the upper portion of packer mandrel 16 carrying ratchet threads 24 thereon is moved upward with respect to ratchet block housing 70, ratchet blocks 82 are rotated radially outward as shown by the arrow in FIG. 2A, pivoting on the points of contact **82*a* between ratchet blocks 82 and housing 70. Retaining spring 90, of course, acts against this rotational movement so that when mandrel means 20 ceases its upward movement, ratchet threads 24 on packer mandrel 24 and ratchet threads 94 on ratchet blocks 82 are forced into engagement by retaining spring 90 and prevent any subsequent downward movement of mandrel means 20 with respect to housing 70, with attendant unwanted retraction of slips 150 and 196 and release of packer element 250**.

If and when packer 10 is to be released, this is easily effected by right-hand rotation of tubing string 4, which causes ratchet threads 24 on packer mandrel 16 to back off from threads 94 on ratchet blocks 82. After a sufficient number of turns, the tubing string 4 can be slacked off, whereupon splines 38 contact lower slip guide 220 at step 238 and pull it down, pulling lower slips 196 free of casing 2, while shoulder 34 pulls slip wedge body 170 down and out from under upper slips 150, freeing them from casing 2. Packer element 250 is, of course, released by the initial downward movement of lower adapter 44 prior to slip retraction.

Thus has been described a novel and unobvious packer, which combines simplicity and ruggedness of design with ease of operation. Furthermore, it will readily be noted that the only part of packer 10 which is exposed to the well environment below packer element 250 is the lower adapter 44. In hostile well environments such as those previously described, this provides significant reliability advantages by protecting the majority of the packer against corrosion, and also keeps any necessary use of exotic, corrosion-resistant materials to a minimum, being required only in lower adapter 44, packer mandrel 16 and upper adapter 12. Packer element 250 shields all other metal components of packer 10 from the annulus 300 below the packer. It will be further apparent to the reader that the packer of the present invention requires only two seals, composite seal 22 and O-ring 46, which greatly enhances long-term reliability.

While the preferred embodiment of the present invention has been illustrated in packer 10 set in casing 2, the invention is not to be construed as so limited. Bridge plugs or other pack-off devices may also be constructed according to the present invention. It should be noted that a bridge plug constructed according to the present invention would be turned "upside down," with the packing element at the top of the tool so as to provide protection from the hostile environment above the tool to corrosion-susceptible parts. The present invention may be employed in cased or uncased well bores. By replacing compression rings 50 and 240 with rings of larger external diameter, and employing a packer element 250 of larger external diameter, larger casing and well bores may be sealed using a single size of pack-off device according to the present invention.

It should be understood that the invention as disclosed possesses utility in a variety of hostile well bore environments, among them the injection of carbon dioxide, the production of sour ($H_2S$ containing) crude oil and oil produced from carbon dioxide injection, waterflood injection, the testing of wells, the steam flooding of wells (with appropriate high temperature packer element material), the treating of wells and the squeeze cementing of wells.

It will be readily apparent to one of ordinary skill in the art that there are numerous additions, deletions and modifications which may be made to the packer or disclosed in the preferred embodiment without departing from the spirit and scope of the claimed invention. For example, the lug could be mounted on the housing, and the J-slot cut into the mandrel; a unitary slip arrangement with slip wedges at both ends might be employed; the positions of the drag springs, slips and J-slot/lug combination may be altered so long as they are placed above the packer element.

I claim:

1. A pack-off device for a well bore, comprising:

mandrel means having first ratchet means and lug means associated therewith;

tubular housing means having second ratchet means, slot means and drag spring means associated therewith;

radially expandable slip means disposed about said mandrel means including upper slips and lower slips adapted to cooperate with slip wedge means and be moved radially outward thereby in response to relative longitudinal movement between said mandrel means and said housing means, said upper slip is secured to said housing means by an upper slip guide, said slip wedge means comprises an annular body having upper and lower channels therein disposed about said mandrel means, said channels possess radially inclined faces, said slip wedge means is longitudinally slidably secured to said upper slip guide, said lower slips have a lower slip guide associated therewith, and said upper and lower slips possess radially inclinded inner faces adapted to cooperate with said channel faces;

a compressible packer element disposed about the lower end of said mandrel means below said lug means, said slot means, said drag spring means and said slip means; and packer element compression means associated with said mandrel means and said housing means.

2. The apparatus of claim 1, wherein said first ratchet means comprises a right-hand lead thread on the exterior of said mandrel means, and said second ratchet means comprises a mating right-hand lead thread on the interior of at least one ratchet block associated with said housing means, said apparatus further including spring means adapted to bias said second ratchet means radially inwardly.

3. The apparatus of claim 2, wherein said at least one ratchet block comprises a plurality of ratchet blocks disposed in ratchet block seats circumferentially spaced about said housing, and said spring means comprises a circumferential spring disposed about said housing and said ratchet blocks.

4. The apparatus of claim 3, wherein said lug means comprises at least one lug extending radially from said mandrel means, and said slot means comprises at least one slot on the interior of said housing means and adapted to receive said lug therein, whereby said housing means and said mandrel means may be selectively locked in a first position with respect to each other, and released from said first position.

5. The apparatus of claim 4, wherein said at least one lug comprises a plurality of lugs, and said at least one slot comprises a plurality of slots.

6. The apparatus of claim 1, wherein said lug means comprises at least one lug extending radially from said mandrel means, and said slot means comprises at least one slot on the interior of said housing means and adapted to receive said lug therein, whereby said housing means and said mandrel means may be selectively locked in a first position with respect to each other, and released from said first position.

7. The apparatus of claim 6, wherein said at least one lug comprises a plurality of lugs, and said at least one slot comprises a plurality of slots.

8. The apparatus of claim 1, wherein said packer element is disposed about said mandrel means below said lower slip guide, and said packer element compression means includes a lower adapter secured to said mandrel means below said packer element and said lower slip guide, said packer element adapted to be longitudinally compressed and radially expanded by relative movement of said lower adapter and said lower slip guide toward each other.

9. The apparatus of claim 1, wherein said packer element compression means includes a first compression ring associated with said housing means and a second compression ring associated with said mandrel means, whereby said packer element is compressed by relative movement of said mandrel means and said housing means toward each other.

10. The apparatus of claim 1, wherein said drag spring means comprises a plurality of radially extending drag springs secured to said housing means.

11. The apparatus of claim 1, further including replaceable compression rings associated with said packer element compression means, whereby said pack-off device may be employed to seal across a variety of well bore diameters by replacing said compression rings with different diameter compression rings, and said packer element by a different diameter packer element.

* * * * *